US007451819B2

(12) United States Patent
Chang et al.

(10) Patent No.: US 7,451,819 B2
(45) Date of Patent: Nov. 18, 2008

(54) OPENHOLE PERFORATING

(75) Inventors: Frank F. Chang, Sugar Land, TX (US); Lawrence A. Behrmann, Houston, TX (US); Ian C. Walton, Sugar Land, TX (US); Keng Seng Chan, Kuala Lumpur (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 374 days.

(21) Appl. No.: 10/907,148

(22) Filed: Mar. 22, 2005

(65) Prior Publication Data

US 2005/0167108 A1 Aug. 4, 2005

Related U.S. Application Data

(60) Continuation-in-part of application No. 10/776,997, filed on Feb. 11, 2004, now Pat. No. 6,966,377, which is a division of application No. 10/316,614, filed on Dec. 11, 2002, now Pat. No. 6,732,798, which is a continuation-in-part of application No. 09/797,209, filed on Mar. 1, 2001, now Pat. No. 6,598,682, and a continuation-in-part of application No. 09/620,980, filed on Jul. 21, 2000, now Pat. No. 6,554,081.

(60) Provisional application No. 60/557,818, filed on Mar. 30, 2004, provisional application No. 60/252,754, filed on Nov. 22, 2000, provisional application No. 60/187,900, filed on Mar. 8, 2000, provisional application No. 60/186,500, filed on Mar. 2, 2000.

(51) Int. Cl.
*E21B 37/00* (2006.01)

(52) U.S. Cl. ..... 166/299; 166/55.1; 166/163; 166/164; 166/311

(58) Field of Classification Search ..... 166/297, 166/311, 299, 55.1, 63, 163, 164
See application file for complete search history.

(56) References Cited

U.S. PATENT DOCUMENTS 2,621,351 A * 12/1952 Piety ..... 15/104.05
2,626,829 A * 1/1953 Maxwell et al. ..... 166/301

(Continued)

FOREIGN PATENT DOCUMENTS

| | | |
|---|---|---|
| GB | 2403968 A | 1/2005 |
| GB | 2406114 A | 3/2005 |
| WO | 01/65060 A1 | 9/2001 |

OTHER PUBLICATIONS

Aslam, J.; Salat, T.A.; "Stimulation of Horizontal Wells in Carbonate Reservoirs"; SPE No. 49493; pp. 259-266.

Behrmann, L.A.; Hughes, K; Johnson, A.B.; Walton, I.C.; "New Underbalanced Perforating Technique Increases Completion Efficiency and Eliminates Costly Acid Stimulation"; SPE No. 77364; pp. 1-15.

Johnson, A.B.; Walton, I.C.; Atwood, D.C.; "Wellbore Dynamics While Perforating and Formation Interaction"; Perforating Research; Schlumberger Wireline and Testing; pp. 1-26.

Scott, S.L.; Wu, Yulin; Bridges, T.J.; "Air Foam Improves Efficiency of Completion and Workover Operations in Low-Pressure Gas Wells"; SPE No. 27922; pp. 219-225.

(Continued)

*Primary Examiner*—Hoang Dang
(74) *Attorney, Agent, or Firm*—Trop, Pruner & Hu, P.C.; Kevin B. McGoff; Bryan P. Galloway

(57) ABSTRACT

An underbalanced perforating system is disclosed for use in openhole completions to maximize the wellbore and matrix cleanup efficiency, to connect natural fracture patterns, and/or to enable application of new drilling fluid technology in difficult subsurface environments. The perforating system can be used for any hydrocarbon bearing formations with any lithology.

8 Claims, 10 Drawing Sheets

U.S. PATENT DOCUMENTS

| | | | | | |
|---|---|---|---|---|---|
| 3,118,501 | A | | 1/1964 | Kenley | |
| 3,163,112 | A | * | 12/1964 | Rhea | 102/310 |
| 3,311,178 | A | * | 3/1967 | McElheny | 175/4.54 |
| 3,589,442 | A | * | 6/1971 | Kilgore | 166/63 |
| 3,709,294 | A | * | 1/1973 | Kilgore | 166/243 |
| 3,760,878 | A | | 9/1973 | Peevey | |
| 4,372,384 | A | | 2/1983 | Kinney | |
| 4,484,632 | A | | 11/1984 | Vann | |
| 4,501,331 | A | | 2/1985 | Brieger | |
| 4,515,217 | A | * | 5/1985 | Stout | 166/297 |
| 4,576,233 | A | | 3/1986 | George | |
| 4,616,701 | A | * | 10/1986 | Stout et al. | 166/55.1 |
| 4,619,325 | A | | 10/1986 | Zunkel | |
| 4,619,333 | A | | 10/1986 | George | |
| 4,621,692 | A | | 11/1986 | Mondshine | |
| 4,629,001 | A | | 12/1986 | Miller et al. | |
| 4,790,385 | A | * | 12/1988 | McClure et al. | 166/299 |
| 4,862,964 | A | | 9/1989 | George et al. | |
| 5,088,557 | A | * | 2/1992 | Ricles et al. | 166/297 |
| 5,135,051 | A | | 8/1992 | Facteau et al. | |
| 5,228,508 | A | | 7/1993 | Facteau et al. | |
| 5,318,126 | A | | 6/1994 | Edwards et al. | |
| 5,551,344 | A | | 9/1996 | Couet et al. | |
| 5,680,905 | A | | 10/1997 | Green et al. | |
| 5,865,254 | A | * | 2/1999 | Huber et al. | 166/373 |
| 6,152,232 | A | | 11/2000 | Webb et al. | |
| 6,173,783 | B1 | | 1/2001 | Abbott-Brown et al. | |
| 6,206,100 | B1 | | 3/2001 | George et al. | |
| 6,343,658 | B2 | | 2/2002 | Webb | |
| 6,598,682 | B2 | | 7/2003 | Johnson et al. | |
| 6,638,896 | B1 | | 10/2003 | Tibbles et al. | |
| 6,732,798 | B2 | | 5/2004 | Johnson et al. | |
| 7,243,725 | B2 | * | 7/2007 | George et al. | 166/299 |
| 2003/0089498 | A1 | | 5/2003 | Johnson et al. | |
| 2004/0089449 | A1 | | 5/2004 | Walton et al. | |

OTHER PUBLICATIONS

Walton, I.C.; Johnson, A.B.; Behrmann, L.A.; Atwood, D.C.; "Laboratory Experiments Provide New Insights into Underbalanced Perforating."; SPE No. 71642; pp. 1-8.

"Implo Treat Systems"; U.S. Department of Energy—Development Report.

"PURE Perforating System: Dynamic Underbalance Technique for Increased Productivity"; www.slb.com/oilfield; Dec. 2004.

* cited by examiner

OPENHOLE PERFORATING

CROSS-REFERENCE TO RELATED APPLICATIONS

This claims the benefit of U.S. Provisional Application Ser. No. 60/557,818, filed Mar. 30, 2004. This is also a continuation-in-part of U.S. Ser. No. 10/776,997, filed Feb. 11, 2004, now U.S. Pat. No. 6,966,377, which is a divisional of U.S. Ser. No. 10/316,614, filed Dec. 11, 2002, now U.S. Pat. No. 6,732,798, which is a continuation-in-part of U.S. Ser. No. 09/797,209, filed Mar. 1, 2001, now U.S. Pat. No. 6,598,682, which claims the benefit of U.S. Provisional Application Ser. Nos. 60/186,500, filed Mar. 2, 2000; 60/187,900, filed Mar. 8, 2000; and 60/252,754, filed Nov. 22, 2000; and U.S. Pat. No. 6,732,798 is also a continuation-in-part of U.S. Ser. No. 09/620,980, filed Jul. 21, 2000, now U.S. Pat. No. 6,554,081.

TECHNICAL FIELD

The present invention relates generally to enhancements in production of hydrocarbons from subterranean formations, and more particularly to a system for perforating in an openhole wellbore.

BACKGROUND

To recover hydrocarbons (e.g., oil, natural gas) it is of course necessary to drill a hole in the subsurface to contact the hydrocarbon-bearing formation. This way, hydrocarbons can flow from the formation, into the wellbore and to the surface. Recovery of hydrocarbons from a subterranean formation is known as "production." In some productions, a casing is installed in the drilled wellbore to provide a structurally-sound conduit to retrieve hydrocarbons. In other productions, hydrocarbons are retrieved from an uncased or "openhole" well.

In openhole well production, one key parameter that influences production rate is the permeability of the formation along the flowpath that the hydrocarbon must travel to reach the wellbore. Sometimes, the formation rock has a naturally low permeability; other times, the permeability is reduced during, for instance, drilling the well. When a well is drilled, a fluid is circulated into the hole to contact the region of the drill bit, for a number of reasons—including, to cool the drill bit, to carry the rock cuttings away from the point of drilling, and to maintain a hydrostatic pressure on the formation wall to prevent production during drilling.

Drilling fluid is expensive particularly in light of the enormous quantities that must be used during drilling. Additionally, drilling fluid can be lost by leaking off into the formation. To prevent this, the drilling fluid is often intentionally modified so that a small amount leaks off and forms a coating or "filtercake" on the openhole wellbore.

Once drilling is complete, and production of the formation via the openhole wellbore is desired, then this filtercake must be removed in order to achieve the targeted productivity. Current cleanup methodology includes applying chemical treatment to dissolve filtercake and near-wellbore damage and/or applying a jet blasting along the wellbore to mechanically break down the filtercake. In long horizontal well, these processes take a considerable amount of time to complete. As a result, when a local section is first cleaned, it becomes conducive for channeling the treating fluid to flow into, leaving majority of the sections not covered by the treating fluid. This inability to uniformly cleanup the entire well is a major problem facing the oil industry when trying to produce from long openhole wells. The second drawback of the current methodology is the inability to deliver the treating fluid deep into the formation beyond the drilling damage. Thus, maximum cleanup of filtercake is not achieved even in the areas that do receive the treating fluid. Because of the combination of these two problems—uneven coverage and shallow penetration of treating fluid—borehole completions often do not perform up to the expectations.

Accordingly, a need exists in the drilling and completions industry for a reliable system for removing filtercake quickly, efficiently, and completely in order to produce the well. This is the primary objective of the present invention.

SUMMARY

In general, according to one embodiment, the present invention provides a system for penetrating the formation of an openhole production well using perforating tools.

For example, an embodiment of the perforation system of the present invention includes the use of one or more shaped charges for penetrating the formation of an openhole wellbore.

In another embodiment, the perforating system of the present invention includes the use of one or more shaped charges for penetrating the formation of an openhole wellbore in a transient underbalanced environment to facilitate more rapid removal of the filtercake from the wellbore.

An object and feature of an embodiment of the present invention is to remove the filtercake from the target production interval of a wellbore rapidly by perforating the wellbore interval with shaped charge detonation in an instantaneous underbalanced environment.

Another object and feature of an embodiment of the present invention is to facilitate the passing of perforation channels through the drilling damage.

Yet another object and feature of an embodiment of the present invention is to perforate an open wellbore to overcome reservoir heterogeneity by detonating more perforations in low permeability well sections and less perforations in high permeability sections. "More" or "less" referring to the quantity and/or power of detonating charges.

Still another object and feature of an embodiment of the present invention is to facilitate production in naturally fractured reservoirs by connecting fracture branches.

Other or alternative features will be apparent from the following description, from the drawings, and from the claims.

BRIEF DESCRIPTION OF THE DRAWINGS

The manner in which these objectives and other desirable characteristics can be obtained is explained in the following description and attached drawings in which.

Figure 1:
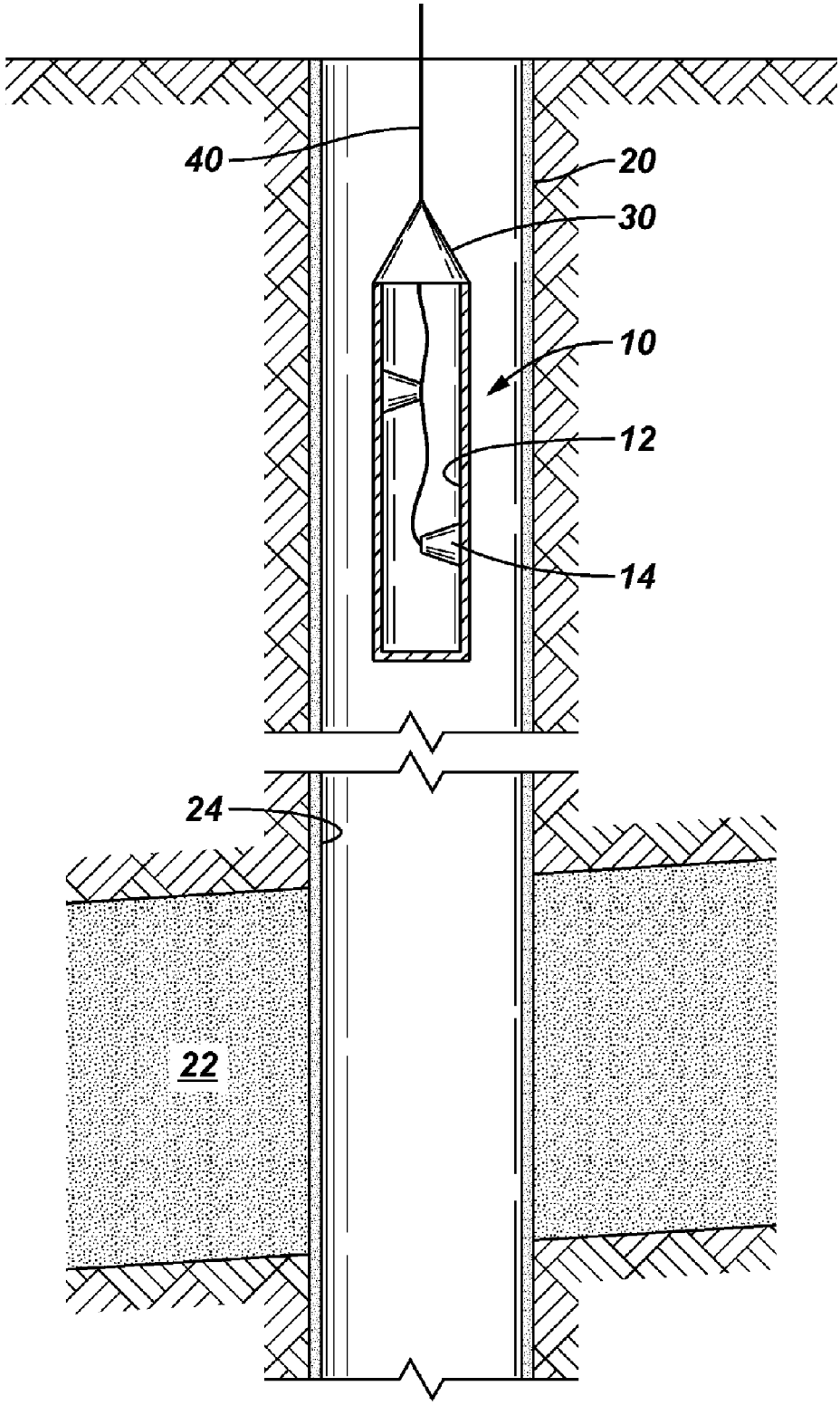
FIG. 1 illustrates an embodiment of a perforating gun positioned in an openhole wellbore and including a gun system according to one of several embodiments.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Generally, tools, systems, and methods are provided for perforating in openhole completions to maximize wellbore and matrix cleanup efficiency (by loosening and/or removing filtercake formed on the openhole wellbore, penetrating into the underlying formation, and enlarging the effective radius of the wellbore past any drilling damage), connect natural fractures, and/or enable application of drilling fluid technology in difficult subsurface environments. The openhole perforating system of the present invention can be used for any hydrocarbon bearing formations with any lithology. In some embodiments of the present invention, an openhole wellbore may be perforated to remove filtercake in an underbalanced, overbalanced, or near-balanced well environment.

In some cases, it is desirable to lower the local pressure condition to enhance transient underbalance during perforation. Treatment of filtercake, as well as removal of perforation damage and charge and formation debris from the perforation tunnels, may be accomplished by increasing the local pressure drop (i.e., increasing the local transient underbalance condition). Various methods and mechanisms may be used to achieve and control a transient underbalanced condition in which to perforate. For example, in one embodiment, a perforating gun with a particular sealed gun body and charge loading may be selected to run in the open wellbore and generate a dynamic underbalance pressure. In this way, rapid removal of filtercake from the wellbore may be achieved. The shaped charges may be selected to either penetrate both the sealed gun body and the formation, or, alternatively, to only puncture the gun body. The sealed gun body includes an interior bore sealed at a particular pressure lower than the surrounding wellbore pressure. Once punctured, a transient underbalanced condition is created by the pressure differential between the surrounding wellbore and the exposed interior of the gun body. This pressure differential creates a temporary surge, which facilitates the rapidly removal of filtercake from the wellbore. In another example, if penetrating through the formation is not required, then a downhole surge tool may be used in place of a perforating gun to create the transient underbalanced condition.

In operation, a well operator identifies or determines a target transient underbalance condition that is desired in a wellbore interval of an openhole well relative to a wellbore pressure (which may be set by reservoir pressure). The target transient underbalance condition can be identified in one of several ways, such as based on empirical data from previous well operations or on simulations performed with modeling software.

Based on the target transient underbalance, the tool string (e.g., perforating gun string) is configured. For example, the gun size, shot density, charge type, phasing, orientation, explosive mass, fluid type (e.g., slowly hydrolyzed acid solutions, surfactants, mutual solvents, chelating fluids, or fluids viscosified by a gelling agent), and conveyance method may be configured appropriately to achieve the target transient underbalance condition. The appropriate configuration can be based on empirical data from previous operations or from software modeling and simulations. Determining the appropriate configuration to use can be determined by software that is executable in a system, such as a computer system. The software is executable on one or more processors in the system. Various other configurations may be made to achieve an optimum result. In some embodiments, for example in completion of a heterogeneous reservoir (i.e., a reservoir having varying degrees of permeability at different zones), the charge loading can be higher against the low permeability zones to increase the flow area after perforating to overcome the preferential flow through the high permeability zone. In other embodiments, the perforating can be oriented according to the reservoir fracture network so that the perforations connect with the natural fracture branches.

Once configured appropriately, the tool string is then lowered to an open wellbore interval, where the tool string is activated to detonate explosives in the tool string. Activation causes substantially (for example 70% of) the target transient underbalance condition to be achieved. Thus, penetration through the filtercake and formation and/or rapid removal of the filtercake is achieved.

Various embodiments of perforating guns and/or other tools are provided below for use with the systems and methods of the present invention to create a transient underbalanced condition in an open wellbore to facilitate the rapid removal of filtercake.

With reference to FIG. 1, according to one embodiment, a perforating gun 10 (single gun or gun string) is positioned in an openhole (i.e., non-cased) wellbore 20 having a producing formation 22 coated in filtercake 24. In another embodiment, the perforating gun is intended to be run through tubing (not shown). The perforating gun 10 may include a sealed gun carrier 12 (or other sealed chamber) and one or more shaped charges 14 arranged therein. The gun carrier 12 may be attached to an adapter 30 that is in turn connected to a carrier line 40 for suspending and carrying the perforating gun 10 into the openhole wellbore 20. The carrier line 40 may include, but is not limited to, a wireline, a slickline, e-line, drill pipe, or coiled tubing. The carrier 12 is sealed to generate a pressure differential in which the internal pressure of the carrier is less than the surrounding wellbore pressure.

Figure 2:
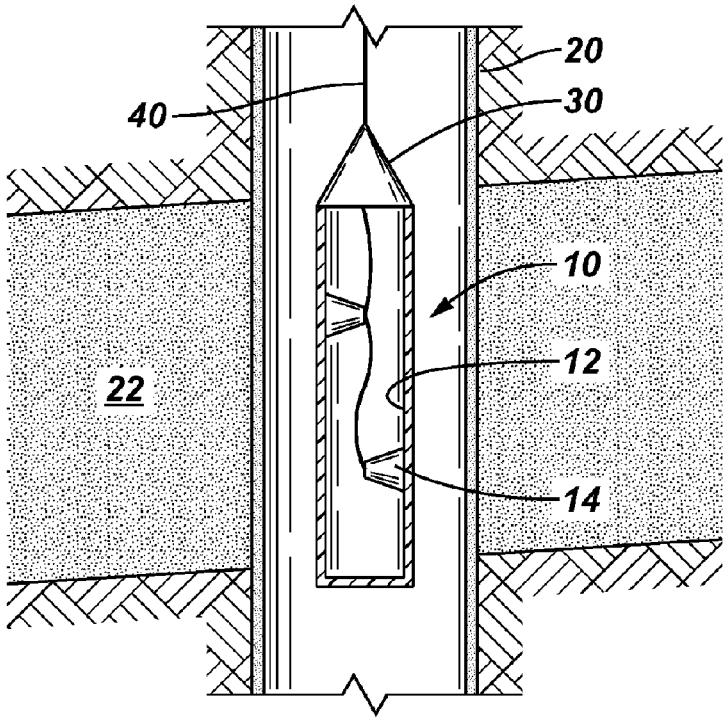
FIGS. 2, 3A, and 3B illustrates embodiments of a perforating gun system for use in generating a transient underbalanced condition in an openhole wellbore.
Figure 3A:
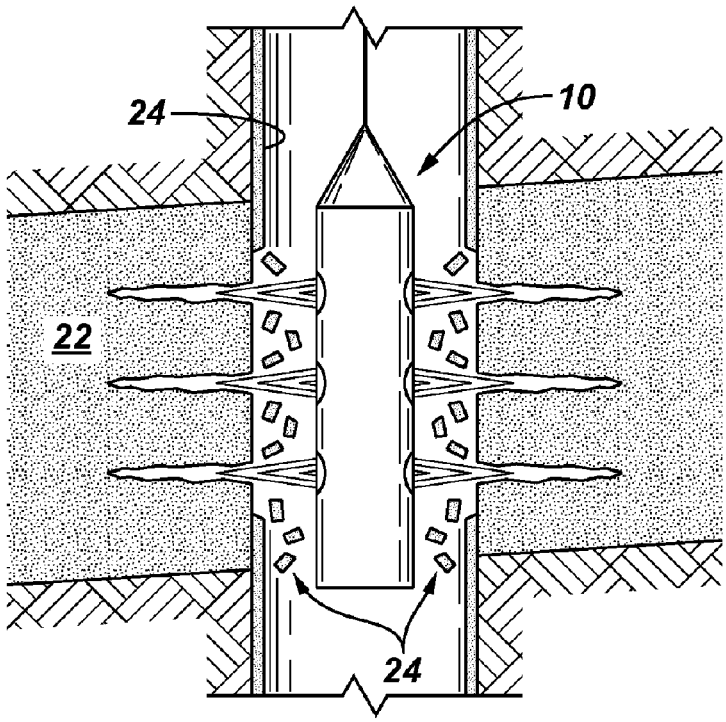
Figure 3B:
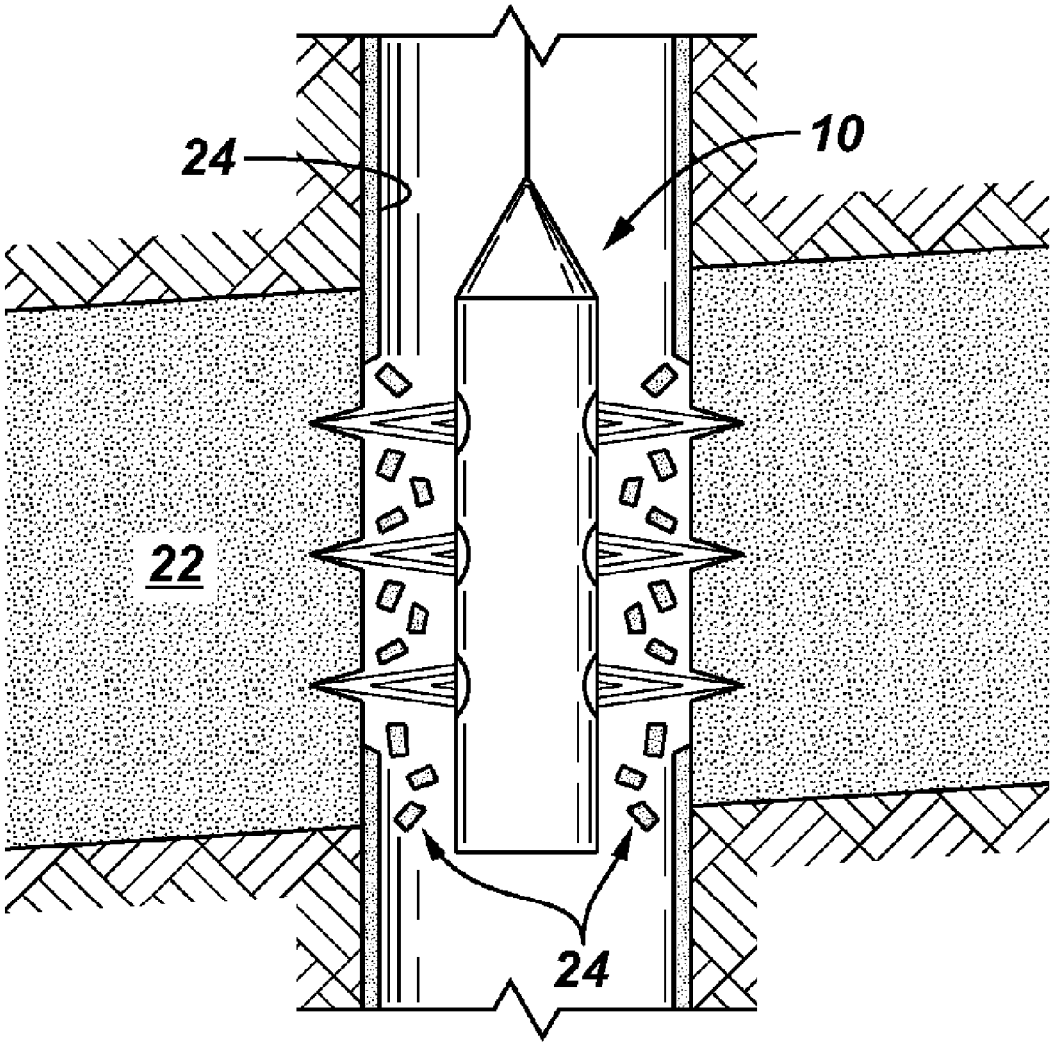

In operation, with respect to FIG. 2, the perforating gun 10 is lowered on a carrier line 40 through the wellbore 20 and positioned adjacent or proximate the formation 22. To assist in removal of the filtercake 24, the perforating gun 10 is ignited. In one embodiments, the perforating gun 10 is configured with shaped charges 14 (or other explosive charges) for penetrating the sealed gun carrier 12 and the surrounding formation 22 (as illustrated in FIG. 3A). In another embodiment, the perforating gun 10 is configured with shaped charges 14 (or other explosive charges) for penetrating the only the sealed gun carrier 12 and not the surrounding formation 22 (as illustrated in FIG. 3B). In both embodiments, once the gun carrier 12 is ruptured, the transient underbalanced pressure differential between the surrounding wellbore and the volume within the gun carrier causes a surge to break or otherwise remove the filtercake 24 from the wellbore 20.

Another embodiment of the present invention includes a perforating gun system provided with a porous material so that, upon firing of the gun system, the sealed volume of the porous material is exposed to the wellbore pressure to transiently decrease the wellbore pressure to enhance the local underbalance condition. Initially, the porous material (e.g., a porous solid) contains sealed volumes that contain gas, light liquids, or a vacuum. When the explosives are detonated, the porous material is crushed or broken apart such that the volumes are exposed to the wellbore. This effectively creates a new volume into which wellbore fluids can flow into, which creates a local, transient pressure drop. As a result, a transient underbalance condition is enhanced by use of a porous material to facilitate removal of filtercake in an open wellbore.

For example, referring to FIGS. 2A-2B, an embodiment of a perforating gun system 100A includes a linear strip 102 to which plural capsule shaped charges 106 are coupled. A detonating cord 103 is connected to each of the shaped charges 106. The shaped charges 106 are mounted in corresponding support rings 104 of a support bracket 105. The support bracket 105 may be twisted to provide a desired phasing (e.g., 45° spiral, 60° spiral, tri-phase, etc.). Alternatively, the support bracket 105 may be arranged in a non-phased pattern (e.g., 0° phasing). In another arrangement, the linear strip 102 may be omitted, with the support bracket 505 providing the primary support for the capsule charges 106.

In one embodiment, the carrier strip 102, support bracket 105, support rings 104, detonating cord 103 and capsule charges 106 are encapsulated in a porous material 110. One example of the porous material includes a porous solid such as porous cement. An example of a porous cement includes LITECRETE®. Porous cement is formed by mixing the cement with hollow structures, such as microspheres filled with a gas (e.g., air) or other types of gas- or vacuum-filled spheres or shells. Microspheres are generally thin-walled glass shells with a relatively large portion being air.

Porous cement is one example of a porous solid containing a sealed volume. When the gas-filled or vacuum-filled hidden structures are broken in response to detonation of the shaped charges 106, additional volume is added to the wellbore, thereby temporarily reducing pressure.

To provide structural support for the encapsulant 110, a sleeve 112 is provided around the encapsulant 110. The sleeve 112 is formed of any type of material that is able to provide structural support, such as plastic, metal, elastomer, and so forth. The sleeve 112 is also designed to protect the encapsulant 110 as the gun system 100A is run into the wellbore and it collides with other downhole structures. Alternatively, instead of a separate sleeve, a coating may be added to the outer surface of the encapsulant 110. The coating adheres to the encapsulant as it is being applied. The coating may be formed of a material selected to reduce fluid penetration. The material may also have a low friction.

In further embodiments, to provide higher pressure ratings, the encapsulant 110 may be formed using another type of material. For example, higher-pressure rated cement with S60 microspheres made by 3M Corporation may be used. As an alternative, the encapsulant 110 may be an epoxy (e.g., polyurethane) mixed with microspheres or other types of gas- or vacuum-filled spheres or shells. In yet a further embodiment, the encapsulant 110 can have plural layers. For example, one layer can be formed of porous cement, while another layer can be formed of porous epoxy or other porous solid. Alternatively, the encapsulant 110 can be a liquid or gel-based material, with the sleeve 112 providing a sealed container for the encapsulant 110.

In some embodiments, the porous material is a composite material, including a hollow filler material (for porosity), a heavy powder (for density), and a binder/matrix. The binder/matrix may be a liquid, solid, or gel. Examples of solid binder/matrix materials include polymer (e.g., castable thermoset such as epoxy, rubber, etc., or an injection/moldable thermoplastic), a chemically-bonded ceramic (e.g., a cement-based compound), a metal, or a highly compressible elastomer. A non-solid binder/matrix material includes a gel (which is more shock compressible than a solid) or a liquid. The hollow filler for the shock impeding material may be a fine powder, with each particle including an outer shell that surrounds a volume of gas or vacuum. In one example embodiment, the hollow filler can include up to about 60% by volume of the total compound volume, with each hollow filler particle including 70% to 80% by volume air. The shell of the hollow filler is impermeable and of high strength to prevent collapse at typical wellbore pressures (on the order of about 10 kpsi in one example). An alternative to use of hollow fillers is to produce and maintain stable air bubbles directly within the matrix via mixing, surfactants, and the like.

In one example embodiment, the heavy filler powder can be up to 50% by volume of the total compound volume, with the powder being a metal such as copper, iron, tungsten, or any other high-density material. Alternatively, the heavy filler can be sand. In other embodiments, the heavy powder can be up to about 10%, 25% or 40% by volume of the total compound volume. The shape of the high-density powder particles is selected to produce the correct mix rheology to achieve a uniform (segregation-free) final compound.

Using sand as the heavy filler instead of metal provides one or more advantages. For example, sand is familiar to field personnel and thus is more easily manageable. In addition, by increasing the volume of sand, the volume of matrix/binder is decreased, which reduces the amount of debris made up of the matrix/binder after detonation.

In some examples, the bulk density of the shock absorbing material ranges from about 0.5 g/cc (grams per cubic centimeter) to about 10 g/cc, with a porosity of the compound ranging from between about 2% to 90%.

Other example porous solids include a 10 g/cc, 40% porous material, such as tungsten powder mixed with hollow microspheres, 50% each by volume. Another example compound includes 53% by volume low- viscosity epoxy, 42% by volume hollow glass spheres, and 5% by volume copper powder. The compound density is about 1.3 g/cc and the porosity is about 33%. Another compound includes about 39% by volume water, 21% by volume Lehigh Class H cement, 40% by volume glass spheres, and trace additives to optimize rheology and cure rate. The density of this compound is about 1.3 g/cc and the porosity is about 30%.

To form the encapsulant 110, the porous material (in liquid or slurry form) may be poured around the carrier strip 102 contained inside the sleeve 112. The porous material is then allowed to harden. With porous cement, cement in powder form may be mixed with water and other additives to form a cement slurry. During mixing of the cement, microspheres are added to the mixture. The mixture, still in slurry form, is then poured inside the sleeve 112 and allowed to harden. The equipment used for creating the desired mixture can be any conventional cement mixing equipment. Fibers (e.g., glass fibers, carbon fibers, etc.) can also be added to increase the strength of the encapsulant.

The encapsulant 110 can also be premolded. For example, the encapsulant can be divided into two sections, with appropriate contours molded into the inner surfaces of the two sections to receive a gun or one or more charges. The gun can then be placed between the two sections which are fastened together to provide the encapsulant 110 shown in FIG. 4B. In yet another example, the porous material may be molded to the shape in between two charges and loaded when the charges are loaded.

Figure 4A:
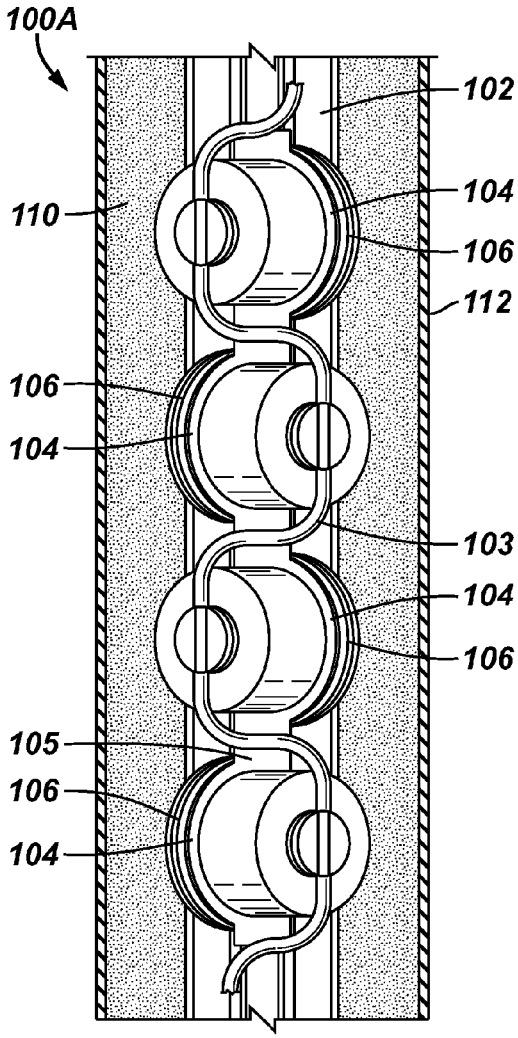
FIG. 4A-4C illustrate embodiments of a hollow gun carrier each including a loading tube in which shaped charges are mounted, with the loading tube filled with a porous material.
Figure 4B:
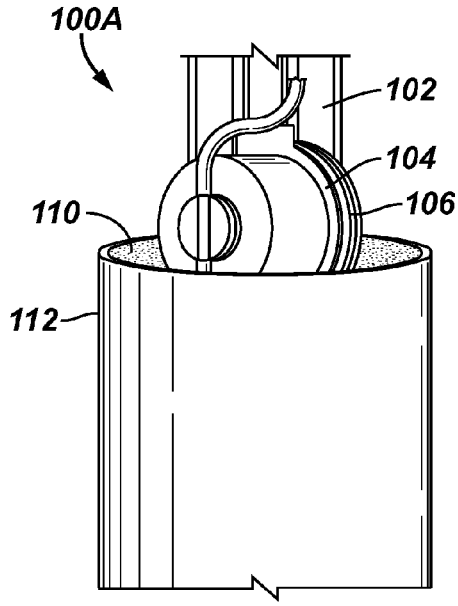
Figure 4C:
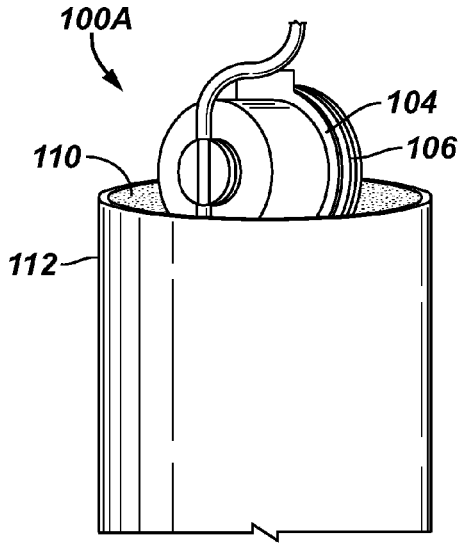

In another embodiment, as shown in FIG. 4C, the linear strip 102 is omitted, with the support bracket 105 and encapsulant 110 providing the needed support.

Figure 5A:
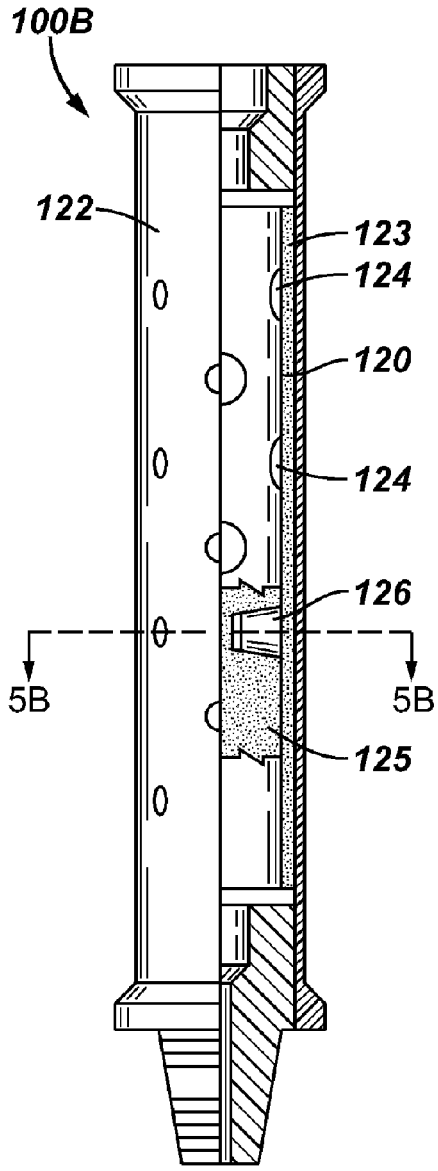
FIGS. 5A-5B illustrate a perforating gun system according to an embodiment of the present invention that includes a carrying tube containing shaped charges and a porous material.
Figure 5B:
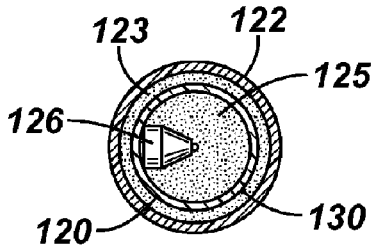

Referring to FIGS. 5A-5B, in accordance with another embodiment, instead of the carrier strip 102 shown in FIGS. 4A and 4B, a similar concept may be extended to a hollow carrier gun 100B for generating a transient underbalanced condition in an open wellbore to facilitate removal of filtercake. In the hollow carrier gun 100B, a loading tube 120 is positioned inside a hollow carrier 122. The loading tube 120 provides openings 124 through which shaped charges 126 may face. The shaped charges 126 may be non-capsule charges since the shaped charges are protected from the environment by the hollow carrier 122, which is typically sealed. After the shaped charges 126 are mounted inside the loading tube 120 during assembly, a porous material (e.g., porous cement) that is initially in liquid or slurry form may be poured through the top or bottom opening 130 of the loading tube. The material is then allowed to solidify to provide a porous material filler 125 inside the loading tube 120. FIG. 5B shows a cross-section of the gun 100B.

The porous material filler can also fill the inside of the hollow carrier 122 to provide a larger volume. In addition to enhancing the local transient underbalance condition, a further benefit of the porous material is that it is an energy absorber that reduces charge-to-charge interference. Also, the porous material may provide structural support for the hollow carrier so that a thinner-walled hollow carrier can be used. The porous material provides support inside the hollow carriers against forces generated due to wellbore pressures. With thinner hollow carriers, a lighter weight perforating gun is provided that makes handling and operation more convenient. A layer 123 formed of a porous material can also be provided around the external surface of the hollow carrier 122. The combination of the porous material inside and outside the hollow carrier 122 to provides a volume to receive wellbore fluids upon detonation.

Figure 6:
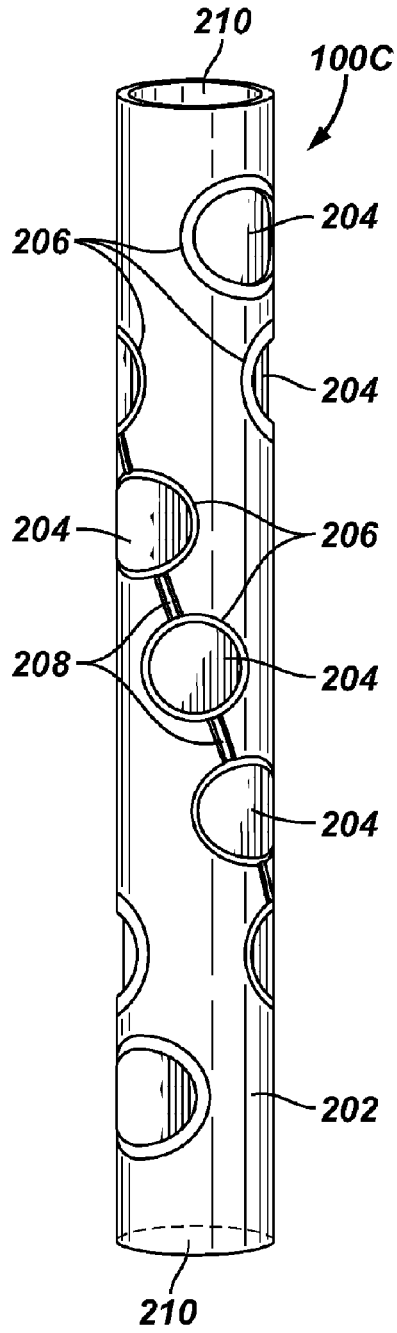
FIG. 6 illustrates an embodiment of a perforating gun system for enhancing a transient underbalance in an open wellbore.

Referring to FIG. 6, in accordance with yet another embodiment, a perforating gun system 100C includes a tubular carrier 202 that may be used to carry capsule charges 204 mounted proximal openings 206 in the tubular carrier 202 for generating a transient underbalanced condition to facilitate the removal of filtercake from a wellbore. The tubular carrier 202 may be arranged in a manner similar to the loading tube 120 of the hollow carrier gun 100B, except that the tubular carrier 202 is not contained inside a hollow carrier. As a result, capsule charges 204 are used instead of the non-capsule charges 106 of FIG. 5A. In one arrangement, a detonating cord 208 may be run along the exterior of the tubular carrier 202 and connected to the capsule charges 206. In another arrangement, the detonating cord 208 may be run inside the tubular carrier 202. As with the loading tube 120 of FIG. 5A, a porous material (e.g., porous cement) that is originally in liquid or slurry form may be poured through a top or bottom opening 210 of the tubular carrier 202. The porous material solidifies inside the tubular carrier 202 to form the porous material for shock and interference reduction. An advantage of using the tubular carrier 202 is that damage to the porous material is less likely because the porous material is protected by the tubular carrier 206, which is typically a sturdy and rigid structure.

Figure 7A:
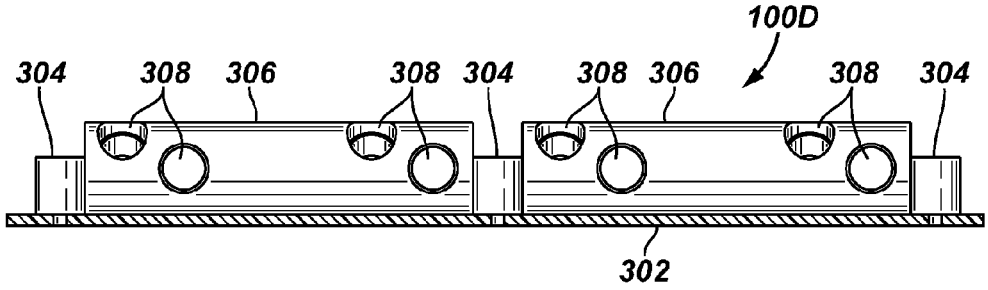
FIG. 7A-7D illustrate various embodiments of perforating guns having porous elements for use with the present invention.

Referring to FIG. 7A, in accordance with yet another embodiment, a strip gun 100D includes plural shaped charges arranged in a phased pattern (e.g., spiral, tri-phased, and so forth) on a linear strip 302. Alternatively, a non-phased arrangement of the charges can be used. The 0°-phased shaped charges (referred to as 304) may be mounted directly to the strip 302. The other charges (not shown) are mounted inside tubes 306 attached to the strip 302. Openings 308 are provided in each tube 306 for corresponding shaped charges. A porous material, which may be one of the porous materials discussed above, is provided in each tube 306.

The tube 306 can be formed of a metal or other suitably rigid material. Alternatively, the tube 306 can also be formed of a porous material, such as a porous solid (e.g., porous cement, porous epoxy, etc.).

Figure 7B:
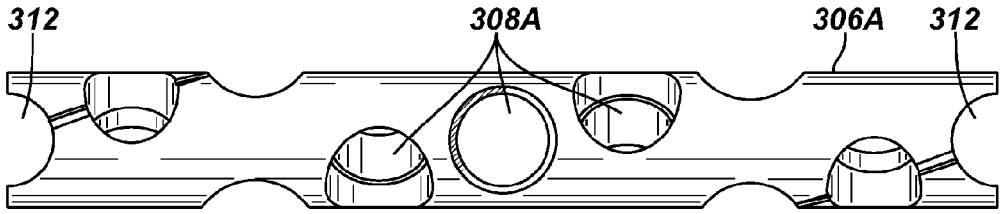
Figure 7C:
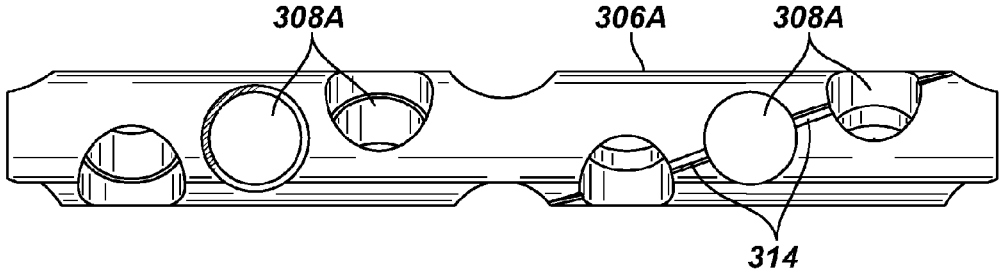
Figure 7D:
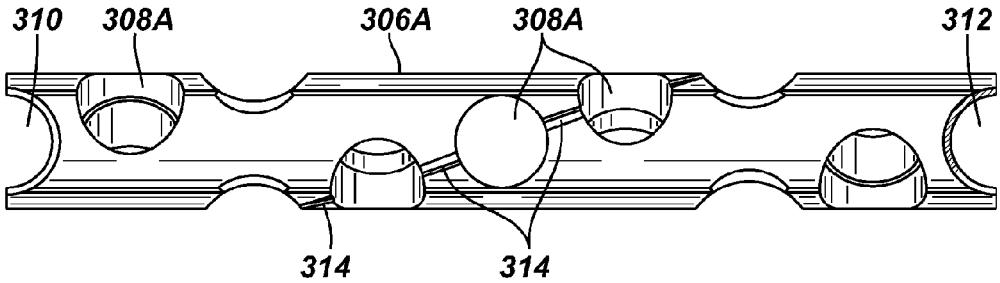

In FIGS. 7B-7D, in another embodiment, instead of a hollow tube 306, a solid bar 306A with cavities 308A (for the shaped charges) is used. FIGS. 7B-7D show three views of three different portions of the bar 306A without the charges mounted therein. The bar 306A can be made of a porous material, such as porous solid. As shown in FIGS. 5B and 5D, first and second grooves 310 and 312 are formed at the ends of the bar 306A to receive the 0°-phased shaped charges 304. Slots 314 are also formed on the outside surface of the bar 306A between the openings 308A to receive a detonating cord that is ballistically coupled to each of the shaped charges in the bar 306A.

To further enhance the underbalance effect, a greater amount of the porous solid can be provided around each gun. For example, a cylindrical block of the porous solid can have a maximum diameter that is slightly smaller than the smallest restriction (e.g., production tubing string) that the gun has to pass through.

Alternatively, a porous slurry can be pumped down and around the gun; in such a scenario, the restriction on size is not a limitation on how much porous material can be placed around the gun. Thus, for example, in FIG. 1, the wellbore annulus 20 around the gun 10 is filled with the porous slurry pumped down tubing and around the gun system 10.

Other embodiments of increasing transient pressure drops, and thus transient underbalance conditions, are described below. In one such other embodiment, a sealed atmospheric container is lowered into the wellbore after a formation has been perforated. After production is started, openings are created (such as by use of explosives, valves, or other mechanisms) in the housing of the container to generate a sudden underbalance condition or fluid surge to remove the damaged filtercake around the perforation tunnels of the formation.

In yet another embodiment, a chamber within the gun can be used as a sink for wellbore fluids to generate the underbalance condition. Following charge detonation, hot detonation gas fills the internal chamber of the gun. If the resultant detonation gas pressure is less than the wellbore pressure, then the cooler wellbore fluids are sucked into the gun housing. The rapid acceleration through perforation ports in the gun housing breaks the fluid up into droplets and results in rapid cooling of the gas. Hence, rapid gun pressure loss and even more rapid wellbore fluid drainage occurs, which generates a drop in the wellbore pressure. The drop in wellbore pressure creates an underbalance condition.

Figure 8:
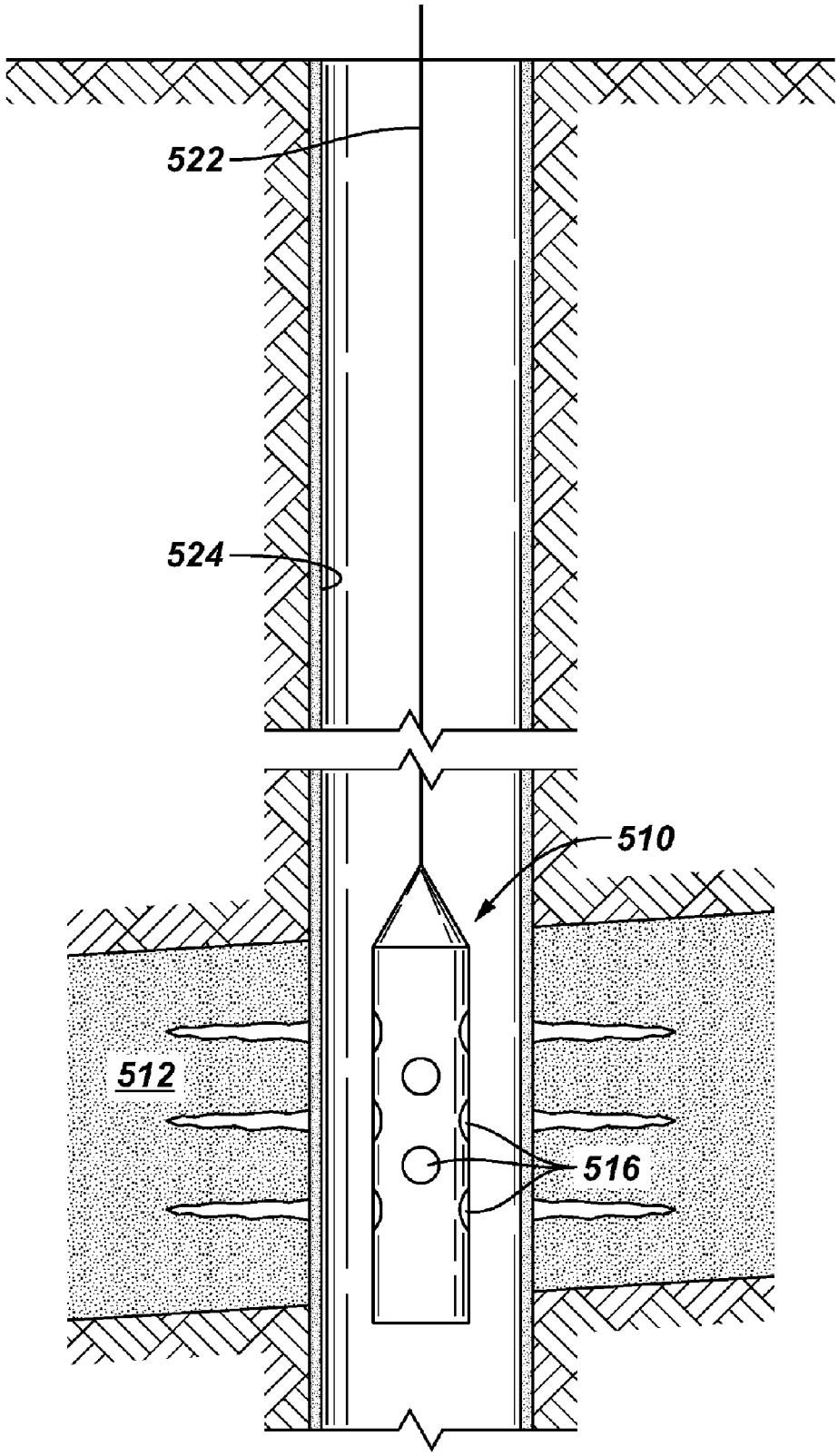
FIG. 8 illustrates an embodiment of a sealed chamber for deploying in an openhole well.

Referring to FIG. 8, a tool string having a sealed atmospheric container 510 (or container having an inner pressure that is lower than an expected pressure in the wellbore in the interval of the formation 512) is lowered into an open wellbore 524 and placed adjacent a perforated formation 512 to be treated. The tool string is lowered on a carrier line 522 (e.g., wireline, slickline, e-line, coiled or jointed tubing, drill pipe, etc.). The container 510 includes a chamber that is filled with a gas (e.g., air, nitrogen) or other fluid. The container 510 has a sufficient length to treat the entire formation 512 and has multiple ports 516 that can be opened up using explosives.

In one embodiment, while the well is producing (after perforations in the formation 512 have been formed), the atmospheric chamber in the container 510 is explosively opened to the wellbore. This technique can be used with or without a perforating gun. When used with a gun, the atmospheric container allows the application of a dynamic underbalance even if the wellbore fluid is in overbalance just prior to perforating. The atmospheric container 510 may also be used after perforation operations have been performed. In this latter arrangement, production is established from the formation, with the ports 516 of the atmospheric container 510 explosively opened to create a sudden underbalance condition.

The explosively actuated container 510 in accordance with one embodiment includes air (or some other suitable gas or fluid) inside. The dimensions of the chamber 510 are such that it can be lowered into a completed well either by wireline, slickline, e-line, coiled or jointed tubing, drill pipe, or other mechanisms. The wall thickness of the chamber is designed to withstand the downhole wellbore pressures and temperatures. The length of the chamber is determined by the thickness of perforated formation being treated. Multiple ports 516 may be present along the wall of the chamber 510. Explosives are placed inside the atmospheric container in the proximity of the ports.

In one arrangement, the tool string including the container 510 is lowered into the wellbore and placed adjacent the perforated formation 512. In this arrangement, the atmospheric chamber 510 is used as a surge-generating device to generate a sudden underbalance condition. Prior to lowering the atmospheric container, a clean completion fluid or treatment fluid may optionally be used to inject into the formation or otherwise fill the wellbore and allow leaking into the formation naturally. The completion fluid is chosen based on the formation wettability, and the fluid properties of the formation fluid. This may help in removing filtercake and/or other particulates from the perforation tunnels during fluid flow.

After the atmospheric container 510 is lowered and placed adjacent the perforated formation 512, the formation 512 is flowed by opening a production valve at the surface. While the formation is flowing, the explosives are set off inside the atmospheric container, opening the ports of the container 510 to the wellbore pressure. The shock wave generated by the explosives may provide the force for freeing filtercake and/or other particles. The sudden drop in pressure inside the wellbore may cause the fluid from the formation to rush into the empty space left in the wellbore by the atmospheric container 510. This fluid carries the mobilized particles into the wellbore, leaving clean formation tunnels and wellbore surface. The chamber may be dropped into the well or pulled to the surface.

Figure 9:
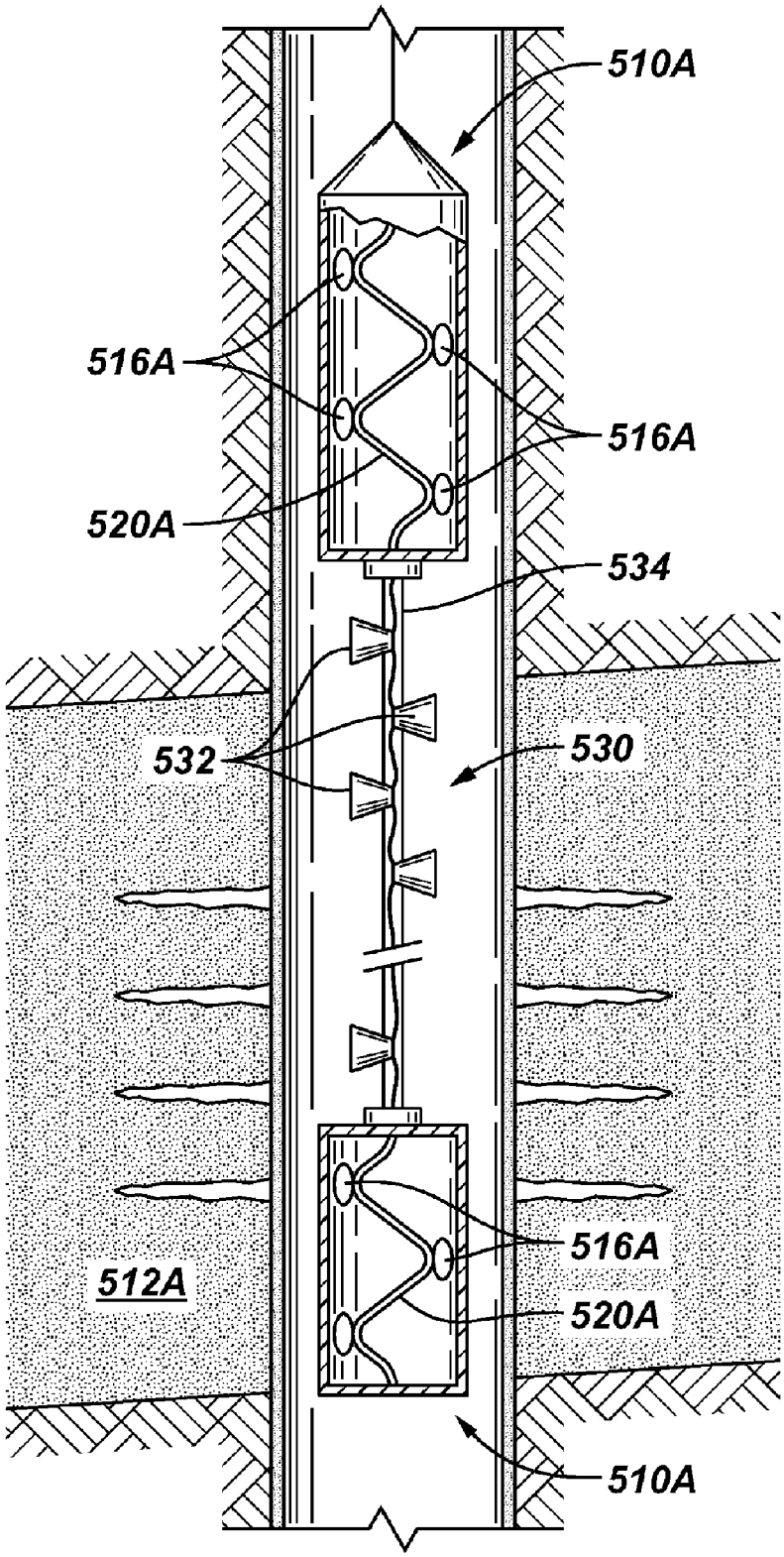
FIG. 9 illustrates an embodiment of a perforating system in accordance with the present invention depicting a perforating gun string and a plurality of sealed chambers.

If used with a perforating gun, activation of the perforating gun may substantially coincide with opening of the ports 516. This provides underbalanced perforation. Referring to FIG. 9, use of an atmospheric container 510A in conjunction with a perforating gun 530, in accordance with another embodiment, is illustrated. In the embodiment of FIG. 7, the container 510A is divided into two portions, a first portion above the perforating gun 530 and a second portion below the perforating gun 530. The container 510A includes various openings 516A that are adapted to be opened by an explosive force, such as an explosive force due to initiation of a detonating cord 520A or detonation of explosives connected to the detonating cord 520A. The detonating cord is also connected to shaped charges 532 in the perforating gun 530. In one embodiment, as illustrated, the perforating gun 530 can be a strip gun, in which capsule shaped charges are mounted on a carrier 534. Alternatively, the shaped charges 532 may be non-capsule shaped charges that are contained in a sealed container.

The fluid surge can be performed relatively soon after perforating. For example, the fluid surge can be performed within about one minute after perforating. In other embodiments, the pressure surge can be performed within (less than or equal to) about 10 seconds, one second, or 100 milliseconds, as examples, after perforating. The relative timing between perforation and fluid flow surge is applicable also to other embodiments described herein.

Figure 10:
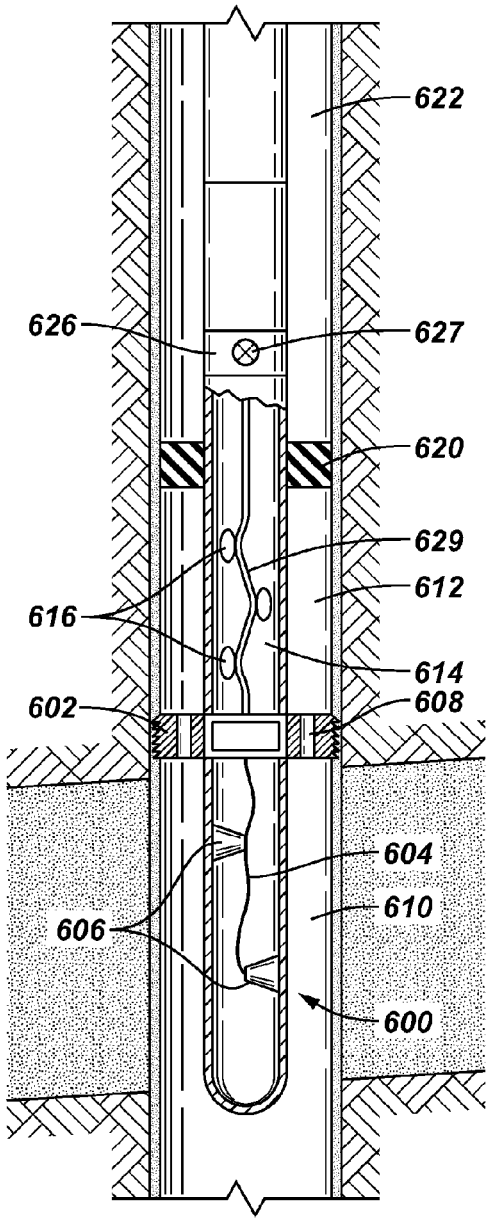
FIG. 10 illustrates an embodiment of a perforating gun string connected to an anchoring device for selectively releasing the perforating gun string.

Referring to FIG. 10, in accordance with another embodiment, a tool string with plural chambers may be employed for use in an open wellbore. The tool string includes a perforating gun 600 that is attached to an anchor 602. The anchor 602 may be explosively actuated to release the perforating gun 600. Thus, for example, activation of a detonating cord 604 to fire shaped charges 606 in the perforating gun 600 will also actuate the anchor 602 to release the perforating gun 600, which will then drop to the bottom of the wellbore.

The anchor 602 includes an annular conduit 608 to enable fluid communication in the annulus region 610 (also referred to as a rat hole) with a region outside a first chamber 614 of the tool string. The first chamber 614 has a predetermined volume of gas or fluid. The housing defining the first chamber 614 may include ports 616 that can be opened, either explosively or otherwise. The volume of the first chamber 614 in one example may be approximately 7 liters or 2 gallons. This is provided to achieve roughly a 200 psi (pounds per square inch) underbalance condition in the annulus region 610 when the ports 616 are opened. In other configurations, other sizes of the chamber 614 may be used to achieve a desired underbalance condition that is based on the geometry of the wellbore and the formation pressure. A control module 626 may include a firing head (or other activating mechanism) to initiate a detonating cord 629 (or to activate some other mechanism) to open the ports 616.

A packer 620 is set around the tool string to isolate the region 612 from an upper annulus region 622 above the packer 620. Use of the packer 620 provides isolation of the rat hole so that a quicker response for the underbalance condition or surge can be achieved. However, in other embodiments, the packer 620 may be omitted. Generally, in the various embodiments described herein, use of a packer for isolation or not of the annulus region is optional.

Figure 11:
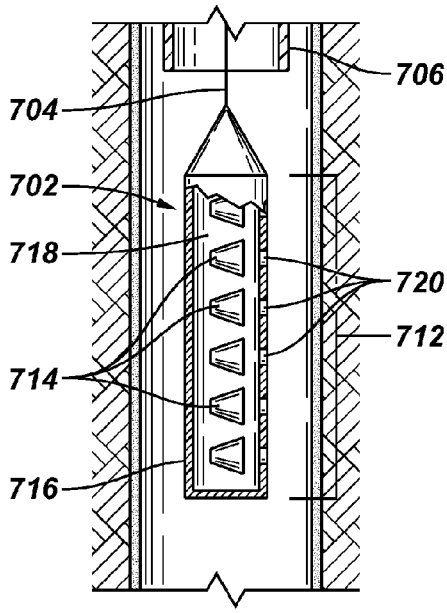
FIG. 11 illustrates an embodiment of a perforating gun string having a plurality of explosive-actuated ports.

Referring to FIG. 11, yet another embodiment for creating an underbalance condition during a perforating operation in an openhole wellbore is illustrated. A perforating gun string includes a perforating gun 702 and a carrier line 704, which can be a slickline, e-line, a wireline, or coiled or jointed tubing, or drill pipe. In one embodiment, the perforating gun 702 is a hollow carrier gun having shaped charges 714 inside a chamber 718 of a sealed housing 716. In the arrangement of FIG. 11, the perforating gun 702 is lowered through a tubing 706. A packer is provided around the tubing 706 to isolate the interval 712 in which the perforating gun 702 is to be shot (referred to as the "perforating interval 712"). A pressure $P_W$ is present in the perforating interval 712.

During detonation of the shaped charges 714, perforating ports 720 are formed as a result of perforating jets produced by the shaped charges 714. During detonation of the shaped charges 714, hot gas fills the internal chamber 718 of the gun 702. If the resultant detonation gas pressure, $P_G$, is less than the wellbore pressure, $P_W$, by a given amount, then the cooler wellbore fluids will be sucked into the chamber 718 of the gun 702. The rapid acceleration of well fluids through the perforation ports 720 will break the fluid up into droplets, which results in rapid cooling of the gas within the chamber 718. The resultant rapid gun pressure loss and even more rapid wellbore fluid drainage into the chamber 718 causes the wellbore pressure $P_W$ to be reduced. Depending on the absolute pressures, this pressure drop can be sufficient to generate a relatively large underbalance condition (e.g., greater than 2000 psi), even in a well that starts with a substantial overbalance (e.g., about 500 psi). The underbalance condition is dependent upon the level of the detonation gas pressure $P_G$, as compared to the wellbore pressure, $P_W$.

When a perforating gun is fired, the detonation gas is substantially hotter than the wellbore fluid. If cold wellbore fluids that are sucked into the gun produce rapid cooling of the hot gas, then the gas volume will shrink relatively rapidly, which reduces the pressure to encourage even more wellbore fluids to be sucked into the gun. The gas cooling can occur over a period of a few milliseconds, in one example. Draining wellbore liquids (which have small compressibility) out of the perforating interval 712 can drop the wellbore pressure, $P_W$, by a relatively large amount (several thousands of psi).

In accordance with some embodiments, various parameters are controlled to achieve the desired difference in values between the two pressures $P_W$ and $P_G$. For example, the level of the detonation gas pressure, $P_G$, can be adjusted by the explosive loading or by adjusting the volume of the chamber 718. The level of wellbore pressure, $P_W$, can be adjusted by pumping up the entire well or an isolated section of the well, or by dynamically increasing the wellbore pressure on a local level.

Instead of perforating guns, other embodiments can employ other types of devices that contain explosive components.

Figure 12A:
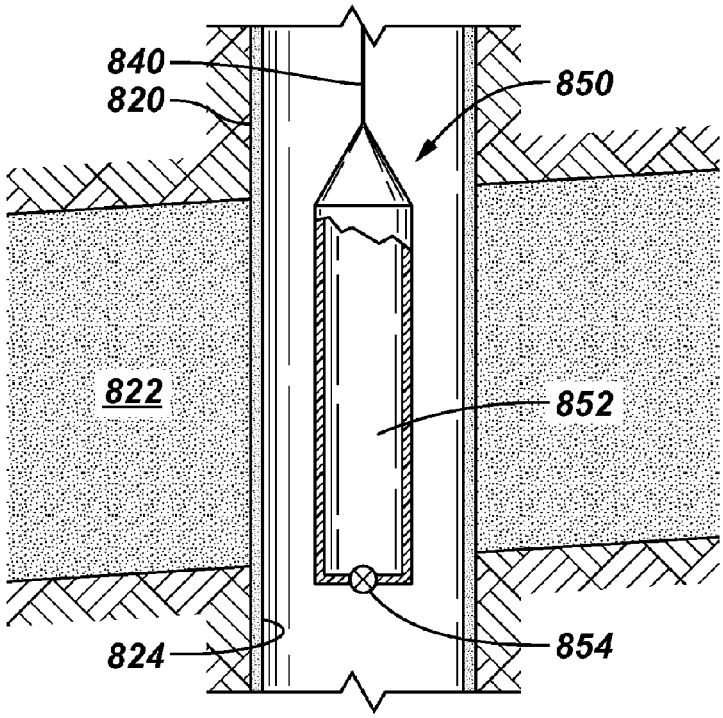
FIG. 12A-12B illustrates an embodiment of a valve-actuated low pressure chamber in accordance with the present invention.
Figure 12B:
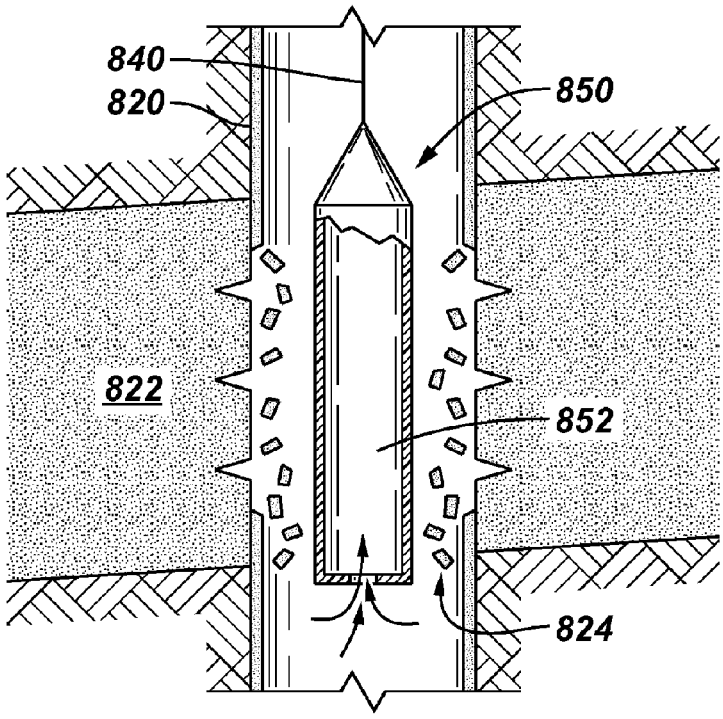

With respect to FIGS. 12A and 12B, in yet further embodiments, a local low pressure drop is enhanced by use of a chamber 850 (or other closure member) containing a relatively low fluid pressure. For example, the chamber 850 includes: (1) a sealed bore 852 containing a gas, liquid, or other fluid at a lower pressure than the surrounding wellbore 820; and (2) a valve 854 for establishing communication between the bore 852 and the wellbore 820. As a result, when the valve 854 of the chamber 850 is opened, a sudden surge of fluid flows into the lower pressure chamber to create the local low pressure condition in a wellbore region in communication with the chamber. The transient low pressure condition and resulting surge serve to remove filtercake 824 from the wellbore 820. In some embodiments, the chamber can be a closed chamber that is defined in part by a closure member located below the surface of the well. In other words, the closed chamber does not extend all the way to the well surface. Alternatively, in other embodiments, the closure member includes a sealed container having ports that include elements that can be shattered by some mechanism (such as by the use of explosive or some other mechanism).

The various embodiments of the perforating mechanisms and processes described above serve several purposes in the openhole. First, by pressure control during perforating, the wellbore wall can be subjected to a high instantaneous underbalance to uniformly remove the filtercake from the entire wellbore rapidly. Secondly, perforating generates flow channels past the drilling damage. Thirdly, perforating allows production profile control to overcome reservoir heterogeneity. This is achieved by shooting more perforations in low permeability sections and less in high permeability sections. Fourthly, perforating can benefit in naturally fractured reservoir by connecting more fracture branches.

In other embodiments, the perforating job is carried out while having a reactive fluid in the wellbore. In such embodiments, an overbalanced perforating is designed such that the pressures recovers to overbalanced after a dynamic underbalance to allow the unspent reactive fluid to penetrate into the formation.

While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. An apparatus for use in an openhole well extending from a well surface, comprising:

a closure member adapted to be positioned in the openhole well, the closure member defining a chamber therein, the chamber having a pressure lower than pressure in the wellbore at a selected wellbore interval; and at least one port selectively openable to establish communication between the chamber and the wellbore interval in the openhole well, wherein the at least one port when opened creating a fluid surge into the chamber to generate a transient underbalance pressure condition in the wellbore interval, the fluid surge to remove filtercake from the wellbore interval;

wherein the closure member and at least one port are configured based on the transient underbalance pressure condition derived according to one of empirical data and modeling software for characteristics of an interval of the openhole well in which the transient underbalance pressure condition is to be created.

2. The apparatus of claim 1, wherein the closure member is a gun carrier for holding at least one explosive charge, and wherein the at least one port in the gun carrier is opened by detonating the at least one explosive charge.

3. The apparatus of claim 1, wherein each of the at least one port comprises a valve.

4. The apparatus of claim 1, wherein each of the at least one port comprises a fluid blocking element adapted to be ruptured by an explosive force, and further comprising an explosive element arranged proximate to the fluid blocking element.

5. The apparatus of claim 1, further comprising:

a perforating gun containing the closure member and having an explosive charge activated to open the at least one port; and a carrier line for suspending the perforating gun in the openhole wellbore such that the explosive charge is proximate the target wellbore interval.

6. The apparatus of claim 5, wherein the closure member comprises a first closure member arranged above or below and proximate to the perforating gun, the first closure member defining the chamber therein, wherein the at least one port of the first closure member creates a fluid surge into the chamber when opened to generate the transient underbalance pressure condition in the target wellbore interval.

7. The apparatus of claim 6, further comprising:

a second closure member arranged opposite the first closure member and proximate to the perforating gun, the second closure member defining a low pressure chamber therein, the second closure member having at least one port selectively openable by the explosive charge of the perforating gun to establish communication between the chamber of the second closure member and the target wellbore interval in the openhole wellbore, wherein the at least one port of the second closure member when opened to create a fluid surge into the chamber of the second closure member to generate the transient underbalance pressure condition in the selected wellbore interval.

8. A method for use in an openhole well, comprising:

ruining a surge tool in the openhole well to a target wellbore interval;

activating the surge tool to generate a flow surge into the surge tool to create a transient underbalanced condition in the target wellbore interval;

removing, by the How surge, filtercake from the target wellbore interval of the openhole well; and configuring the surge tool based on the transient underbalanced condition derived according to one of empirical data and modeling software for characteristics of the target wellbore interval in the openhole well in which the transient underbalanced condition is to be created.

* * * * *